US008322714B2

(12) United States Patent
Satomi

(10) Patent No.: US 8,322,714 B2
(45) Date of Patent: Dec. 4, 2012

(54) SHEET CONVEYING APPARATUS AND IMAGE FORMING APPARATUS

(75) Inventor: Yoshiyasu Satomi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 17 days.

(21) Appl. No.: 12/473,548

(22) Filed: May 28, 2009

(65) Prior Publication Data

US 2009/0295078 A1 Dec. 3, 2009

(30) Foreign Application Priority Data

May 28, 2008 (JP) ..... 2008-139670

(51) Int. Cl.
*B65H 5/00* (2006.01)

(52) U.S. Cl. ..... 271/264

(58) Field of Classification Search ..... 271/264, 271/207, 209
See application file for complete search history.

(56) References Cited

U.S. PATENT DOCUMENTS

| | | | | |
|---|---|---|---|---|
| 5,000,438 | A * | 3/1991 | Sardano et al. | 271/264 |
| 5,893,558 | A * | 4/1999 | Konig et al. | 271/264 |
| 6,241,245 | B1 * | 6/2001 | Hollar et al. | 271/314 |
| 7,448,621 | B2 * | 11/2008 | Yasumoto | 271/264 |
| 7,661,673 | B2 * | 2/2010 | Doyo | 271/264 |
| 7,715,757 | B2 * | 5/2010 | Tanaka et al. | 399/124 |
| 8,016,287 | B2 * | 9/2011 | Watanabe | 271/209 |
| 2003/0011126 | A1 * | 1/2003 | Miyazawa | 271/264 |
| 2005/0067773 | A1 * | 3/2005 | Yoshida et al. | 271/264 |
| 2005/0093222 | A1 * | 5/2005 | Ouchi et al. | 271/9.09 |
| 2006/0071417 | A1 * | 4/2006 | Baba | 271/264 |
| 2007/0092320 | A1 | 4/2007 | Taniguchi et al. | |
| 2007/0152398 | A1 * | 7/2007 | Watanabe | 271/264 |
| 2008/0296837 | A1 * | 12/2008 | Jowett et al. | 271/264 |
| 2009/0324311 | A1 * | 12/2009 | Matsumoto | 399/400 |
| 2010/0207323 | A1 * | 8/2010 | Kumeta et al. | 271/264 |

FOREIGN PATENT DOCUMENTS

| | | | |
|---|---|---|---|
| JP | 4-291276 | A | 10/1992 |
| JP | 06032470 | A * | 2/1994 |
| JP | 8-002773 | A | 1/1996 |
| JP | 2001-315993 | A | 11/2001 |
| JP | 2006-111364 | A | 4/2006 |
| JP | 2006-327737 | A | 12/2006 |
| JP | 2007-099480 | A | 4/2007 |

* cited by examiner

*Primary Examiner* — Prasad Gokhale
(74) *Attorney, Agent, or Firm* — Canon USA Inc. IP Division

(57) ABSTRACT

A sheet conveying apparatus includes a guide unit configured to form a conveyance path on which a sheet passes wherein the guide unit includes curved portions curved in a thickness-direction of the conveyed sheet, and a flat portion. The guide unit includes a rib contacting with the sheet and disposed continuously spreading over the curved portions and the flat portion. The rib has at least a part tilted with respect to the sheet conveying-direction in the curved portion more than in the flat portion.

12 Claims, 4 Drawing Sheets

SHEET CONVEYING APPARATUS AND IMAGE FORMING APPARATUS

BACKGROUND OF THE INVENTION

1. Field of the Invention

The present invention relates to a sheet conveying apparatus for conveying sheets.

2. Description of the Related Art

The sheet conveying apparatus used for an electrophotographic apparatus conveys and guides a sheet by a guide unit.

The guide unit uses a plate-shaped member made of metal or plastic. When the guide unit is a flat plate, contact resistance with a sheet is large, which increases frequency of jamming. Thus, to reduce conveying resistance which causes jamming, many ribs are disposed in a guiding surface of the guide unit to improve sheet guiding performance.

Regarding the ribs arranged in the guide unit, there are ribs pushed wide in a sheet width direction toward a downstream side in a sheet conveying direction (discussed in Japanese Patent Application Laid-Open No. 2001-315993).

As discussed in Japanese Patent Application Laid-Open No. 2001-315993, when the ribs are disposed to be pushed wide in the sheet width direction toward the downstream side of the sheet conveying direction, areas of the sheet that contacts with the convey ribs are dispersed without concentrating in one spot in the width direction. Thus, surfaces of the convey ribs give little damage to the sheet. On the other hand, when the ribs are disposed to be pushed wide in the sheet width direction toward the downstream side of the sheet conveying direction, a plurality of rib start points (rib conveying-direction upstream ends) has to be provided in the sheet conveying direction. The rib start points and the conveyed sheet come into point-contact with each other, which concentrates a rubbing force. The concentration of the rubbing force between the sheet and the rib start points may cause damage to a surface of the sheet. In other words, when the ribs are tilted with respect to the sheet conveying-direction, while the surface of the convey ribs give little damage to the sheet, rib start points cause damage to the sheet. If the ribs are arranged parallel to sheet conveying-direction, a number of rib start points can be reduced, however, the surface of ribs causes damage to the sheet. While the problem occurs in the case in which the ribs are tilted with respect to the sheet conveying-direction, the contradictory problem occurs in the case in which the ribs are arranged parallel to sheet conveying-direction contradict each other.

A thermal content of thick coated paper is large immediately after a toner image is fixed on the sheet by heat, the sheet, given heat during the fixing, is conveyed in a very hot state. In consequence, while not fixed on the sheet, toner is brought into contact with the rib start points of the guide unit disposed in a conveying path in a soft state, and it is highly possible that rib traces are left or uneven gloss appears as damage.

SUMMARY OF THE INVENTION

The present invention is directed to reduction of sheet damage caused by ribs for guiding a conveyed sheet.

According to an aspect of the present invention, a sheet conveying apparatus includes a guide unit configured to form a conveyance path on which a sheet to be conveyed passes, and including portions curved in a thickness direction of the conveyed sheet, and a flat portion, and a rib configured to contact the sheet and disposed continuously extending over the curved portions and the flat portion in the guide unit. The rib has at least a part tilted with respect to the sheet conveying-direction in the curved portion more than in the flat portion.

The present invention enables reduction of sheet damage caused by rubbing between the sheet and the rib at the curved portion or by a start point of the rib.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
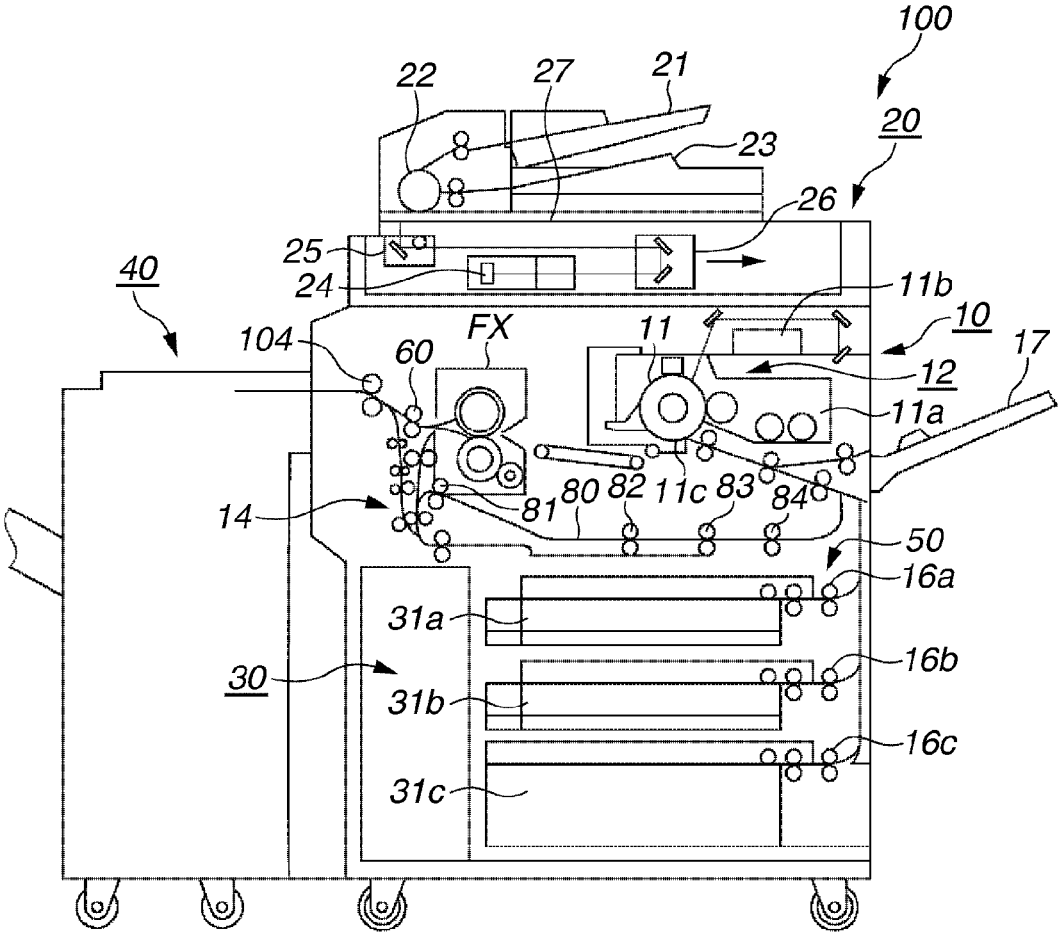
FIG. 1 is a sectional diagram illustrating an image forming apparatus which includes a sheet conveying apparatus according to an exemplary embodiment of the present invention.

FIG. 1 illustrates a schematic configuration of an image forming apparatus which includes a sheet conveying apparatus according to an exemplary embodiment of the present invention.

FIG. 1 illustrates an image forming apparatus 100 and an image forming apparatus main body 10 (apparatus main body hereinafter).

An image reading unit 20 is disposed in the upper part of the apparatus main body 10 to generate image data by reading an image of a document set on an original platen 27.

The image reading unit 20 includes a document feeding tray 21 for placing documents, and a platen roller 22 for conveying documents and forming a reading position. The image reading unit 20 includes a document discharge tray 23 for placing read documents, and an image sensor 24 for receiving an image light to convert it into an image signal. The image reading unit 20 includes a first movable scanning unit 25 configured of a lamp and a mirror for illuminating documents to scan the documents set on the original platen 27. The image reading unit 20 further includes a second scanning unit 26 configured of two mirrors and movable at half a speed of the first scanning unit 25.

The image reading unit 20 has a function of reading a document by conveying the document from the document feeding tray 21, and a function of reading a document by scanning a stationary document set on the original platen 27.

The image reading unit 20 includes an image forming unit 12 for forming an image on a sheet by electrophotographic method.

Below the image forming unit 12, a paper feeding unit 50 is disposed to feed a sheet to the image forming unit 12. On one side of the apparatus main body 10, a processing unit 40 is provided which performs binding, shifting, folding or punching for an image-formed sheet discharged from the apparatus main body 10.

The image forming unit 12 includes a photosensitive drum 11, a developing device 11*a*, and a laser scanner unit 11*b*.

The paper feeding unit 50 includes a sheet housing unit 30 equipped with a plurality of cassettes 31 (31*a* to 31*c*) detachable from the apparatus main body 10 for storing a sheet P, and feeding units 16 (16*a* to 16*c*) for feeding sheets stored in the cassettes 31. The image forming apparatus 100 includes a manual paper feeding unit 17. Sheets are fed from the paper feeding unit 50 and the manual paper feeding unit 17 to the image forming unit 12.

Next, an operation of the image forming apparatus 100 thus configured will be described. A controller (not shown) provided in the apparatus main body 10 outputs an image reading start signal to the image reading unit 20. Then, a document set on the original platen 27 or a document conveyed by the platen roller 22 is irradiated with a light from a light source of the first scanning unit 25. A reflected light from the document enters the image sensor 24 via the first and second scanning units 25 and 26. The light that has entered the image sensor 24 is converted into an electric signal.

Then, the laser scanner unit 11*b* emits a laser beam corresponding to the electric signal to the photosensitive drum 11.

The photosensitive drum 11 that has been charged in advance is irradiated with a light to form an electrostatic latent image, and the developing device 11*a* develops the electrostatic latent image to form a toner image on the photosensitive drum 11.

When the controller outputs a paper feeding signal to the paper feeding unit 50, the sheet P is fed from the cassette 31 or the manual paper feeding unit 17. The fed sheet P is sent to a transfer unit configured of the photosensitive drum 11 and a transfer charging device 11*c* at predetermined timing.

The toner image is transferred onto the sheet sent to the transfer unit, and then conveyed to a fixing unit FX. The fixing unit FX applies heat and pressure to permanently fix an unfixed transfer image on the sheet P. The sheet that has the fixed image is discharged from the apparatus main body 10 by a discharge roller 104 to be received by the processing unit 40.

The image forming apparatus 100 has a two-sided image forming function and an inverse discharging function.

Figure 2:
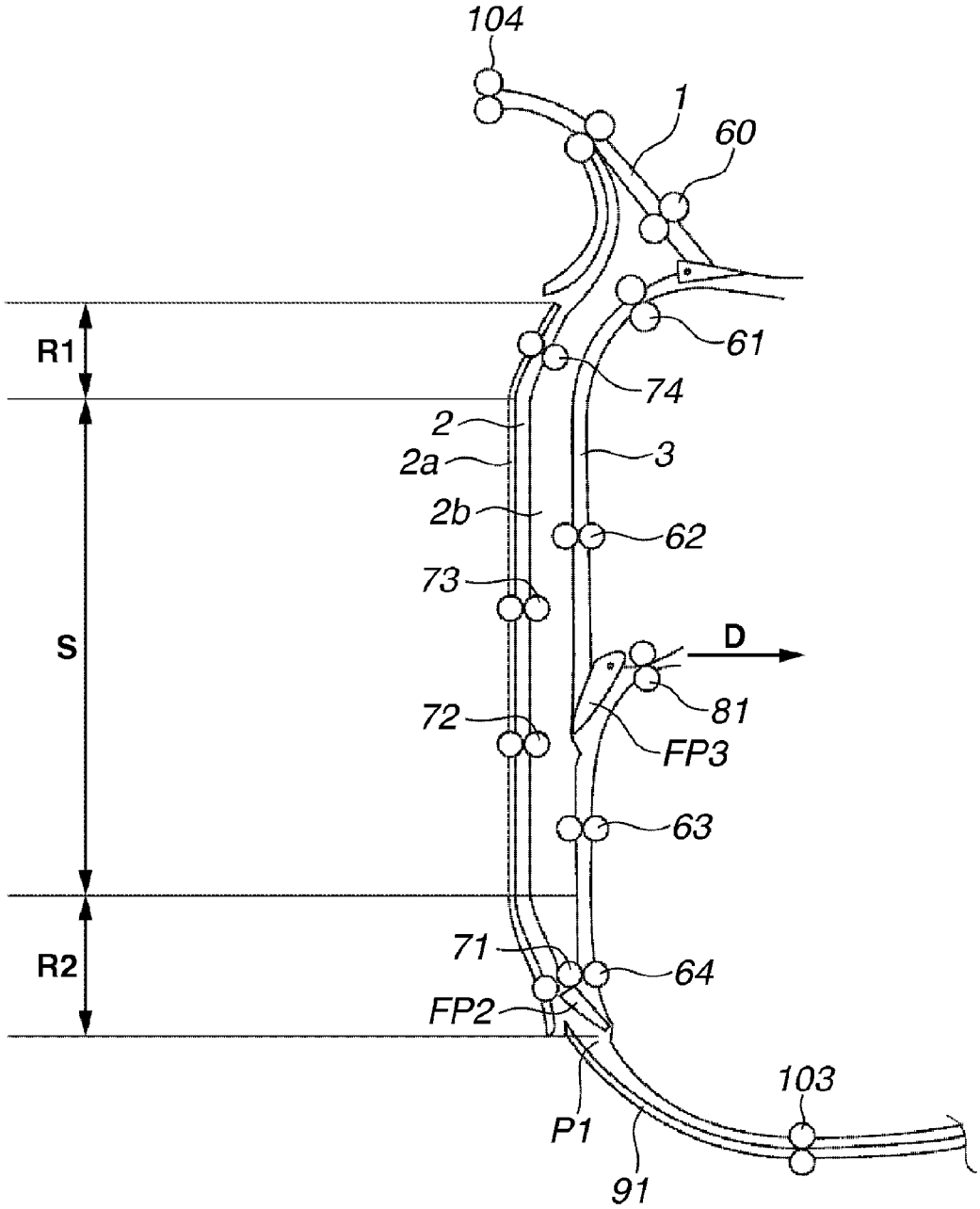
FIG. 2 is a sectional diagram illustrating an inverse paper discharging portion in the sheet conveying apparatus of the exemplary embodiment of the present invention.

FIG. 2 illustrates an inversion discharge unit 14. In a straight discharge mode, a sheet is conveyed on a straight conveyance path 1 by a straight convey roller 60, and discharged from the apparatus main body 10 by the discharge roller 104 to be received by the processing unit 40.

In an inverse discharge mode, a sheet is first conveyed to a first inverse conveyance path 3. After the sheet is conveyed on the first inverse conveyance path 3 by convey rollers 61 to 64, a trailing edge of the sheet is sent up to an inverse point P1. Then, a rotational direction of an inversion roller 103 is reversed so that a conveying direction of the sheet becomes opposite. The sheet is guided to a second inverse conveyance path 2 by an inverse flapper (inverse swing guide) FP2, and conveyed upward by convey rollers 71 to 74 serving as sheet conveying units. The sheet conveyed by the convey rollers 71 to 74 is discharged from the apparatus main body 10 by the discharge roller 104 and received by the processing unit 40.

In a two-sided mode for forming images on both sides of a sheet, a first surface of a sheet on which fixing has been performed by the fixing unit FX is first conveyed to the first inverse conveyance path 3. The convey rollers 61 to 64 convey the sheet until its trailing edge reaches the inverse point P1. Then, rotational directions of the convey rollers 63 and 64 are reversed so as to change a sheet conveying direction to an opposite one. A two-sided flapper (two-sided swing guide) FP3 guides the sheet in a D direction, i.e., to a two-sided conveyance path 80. The sheet that has been conveyed on the two-sided conveyance path by the two-sided convey rollers 81 to 84 is sent again to the image forming unit 12. An image is formed this time on the second surface of the sheet. Then, the sheet is sent to the straight conveyance path, and discharged from the apparatus main body 10 by the discharge roller 104.

A configuration of a guide constituting the second inverse conveyance path 2 will be described in detail. The second inverse conveyance path 2 on which the conveyed sheet passes includes an outer guide 2*a* and an inner guide 2*b*. As illustrated in FIG. 2, the second inverse path 2 includes a lower curved portion R2 which is a lower portion of the second inverse conveyance path 2, an upper curved portion R1 which is an upper portion of the second inverse convey, and a flat straight portion S formed between the lower and upper curved portions R2 and R1. The outer guide 2*a* as a guiding unit forms an inner side of the upper and lower curved portions R1 and R2 in a curving direction in the second inverse conveyance path 2. The inner guide 2*b* forms an inner side of the upper and lower curved portions R1 and R2 in the curving direction in the second inverse conveyance path 2.

Figure 3:
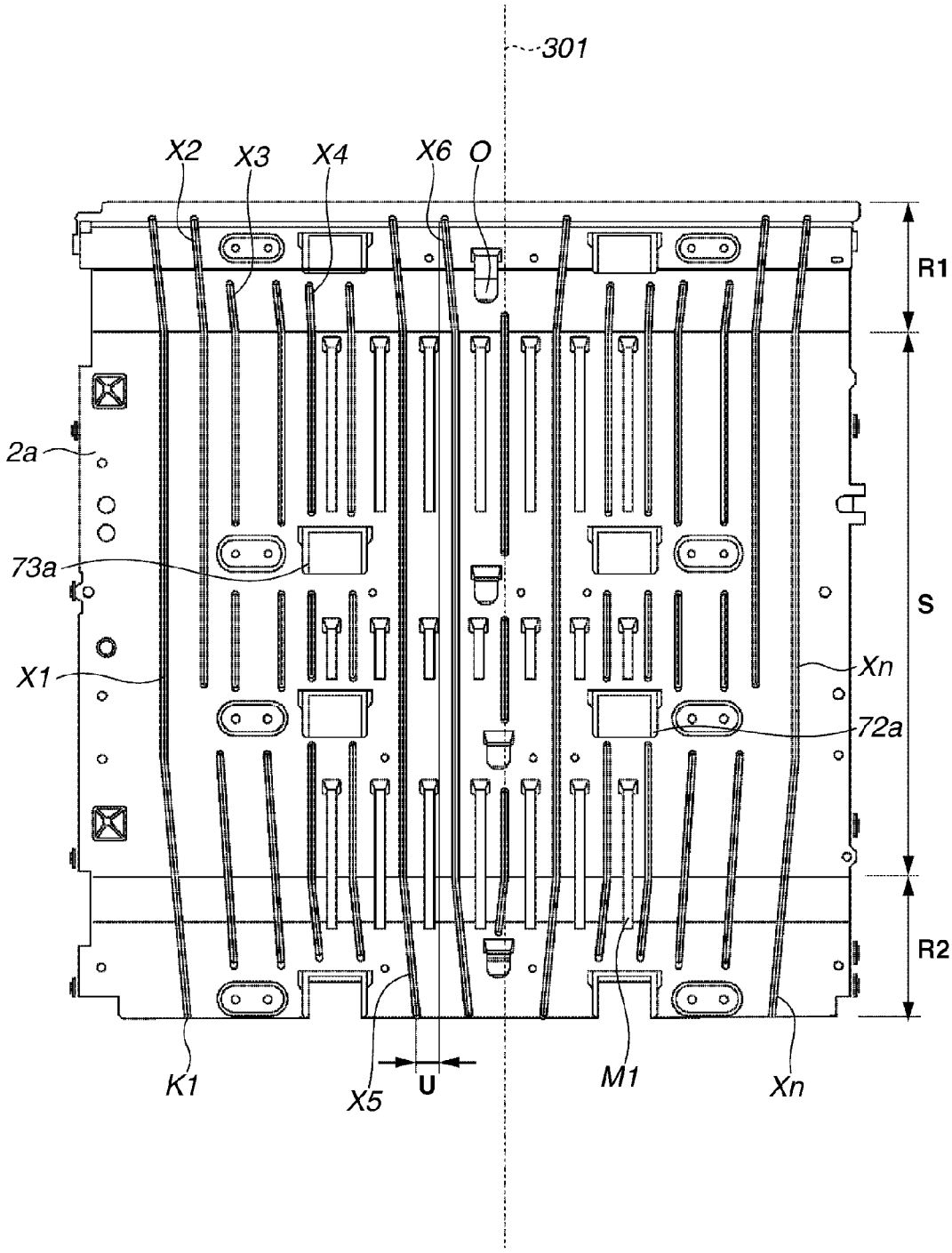
FIG. 3 is a plan diagram illustrating a configuration of an outer guide in the sheet conveying apparatus of the exemplary embodiment of the present invention.

FIG. 3 is a plan diagram illustrating the outer guide 2*a*. The outer guide 2*a* serving as a sheet guiding unit is a guide plate configured to continuously form the upper and lower curved portions R1 and R2 and the straight portion S. In the exemplary embodiment, the outer guide 2*a* is an integrally formed single resin member.

The outer guide 2*a* includes vent holes M1 formed in the conveying direction. The outer guide 2*a* includes a plurality of convey ribs X1 to Xn. The plurality of convey ribs X1 to Xn are arranged in a line that is parallel to a direction intersecting the sheet conveying-direction. Each of the convey ribs X1 to Xn extends approximately in a conveying path of the sheet. A sheet width direction is a direction which intersects with the sheet conveying-direction. The convey ribs X1 to Xn guide the sheet in contact with the conveyed sheet, and serve to reduce sheet conveying resistance. The vent holes M1 are formed among the plurality of convey ribs X1 to Xn and inside a minimum sheet size.

A reflection sensor O is disposed in a center of the width direction to count conveying timing of the sheet P.

As described above, the outer guide 2*a* includes the plurality of convey ribs X1 to Xn formed on its surface, which extend in the sheet conveying direction. A start point K1 of the convey rib X1 is set not to be in the same position as that of an end of a typical size sheet so that various typical size sheets applicable to the image forming apparatus can be stably conveyed. To reduce the number of rib start points, in an area from the lower curved portion R2 to the upper curved portion R1, the ribs are arranged to be continuous without breaking the ribs as much as possible.

The outer guide 2*a* includes apertures 72*a*, 73*b* and 74*c* formed in positions opposed to the convey rollers 72 to 74. In an area including the apertures 72*a*, 73*b* and 74*c* extending in the width direction (area where the apertures 72*a*, 73*b* and 74*c* match the sheet conveying direction), several convey ribs X3, X4, . . . among the plurality of convey ribs X1 to Xn are broken in the midway of the conveying path. In this area, however, the convey rollers 72 to 74 sandwich and convey the sheet. Thus, start points of the convey ribs X3, X4, . . . are not strongly rubbed by the conveyed sheet.

The convey ribs X1 to Xn are arranged in the upper and lower curved portions R1 and R2 to push the sheet wider in the width direction toward a downstream side in the sheet conveying direction. In other words, in the area of the upper and lower curved portions R1 and R2, the conveyance ribs X1 to Xn are tilted at predetermined angles with respect to the sheet conveying direction.

In the straight portion S, at least a part of the convey ribs X1 to Xn are arranged in the conveying direction to be parallel to the sheet conveying direction.

Thus, in the upper and lower curved portions R1 and R2, which are rubbed relatively strongly by the outer guide 2*a* due to stiffness of the sheet, the convey ribs X1 to Xn tilt in the sheet conveying direction. Accordingly, in the upper and lower curved portions R1 and R2, area of sheet that contact with the convey ribs X1 to X2 of the outer guide 2*a* are dispersed without concentrating in one spot of the width direction. Thus, even when the outer guide 2*a* rubs the sheet relatively strongly in the upper or lower curved portions R1 or R2, the convey ribs X1 to Xn give little damage to the sheet. In the straight portion S, some places of the convey ribs X1 to Xn are parallel to the sheet conveying path. In other words, an angle formed by at least part of the convey ribs X1 to Xn in the straight portion S to the sheet conveying direction is smaller than an angle formed by the ribs X1 to Xn in the upper and lower curved portions R1, R2 to the sheet conveying direction. The convey ribs X1 to Xn can accordingly be formed to be continuous without any breaks. Thus, the number of start points of the convey ribs can be reduced, so that damaging of the sheet by the start points of the convey ribs can be prevented. In the straight portion S, an increase in rubbing force with the outer guide 2*a* due to stiffness of the sheet is limited as compared with the upper and lower curved portions R1 and R2. As a result, in the straight portion S, damaging of the sheet is limited even when the angle between the convey ribs X1 to Xn and the sheet conveying direction is smaller than the predetermined angle formed by the ribs X1 to Xn in the upper and lower curved portions R1, R2 to the sheet conveying direction.

Adjacent ribs among the convey ribs X1 to Xn are arranged not to overlap each other on a line parallel to the sheet conveying direction. In other words, in a case of the adjacent convey ribs X5 and X6, for example, a space U is present between a part of the convey rib X5 nearest to the convey rib X6 in a width direction (direction intersecting the sheet conveying direction) and a part of the convey rib X6 nearest to the convey rib X5.

Thus, over the entire sheet surface, the contact spots of the sheet with the convey ribs X1 to Xn are dispersed, enabling reduction of damage to the sheet.

The plurality of convey ribs X1 to Xn are arranged to be roughly left-right symmetrical with respect to a sheet conveying center 301.

Figure 4:
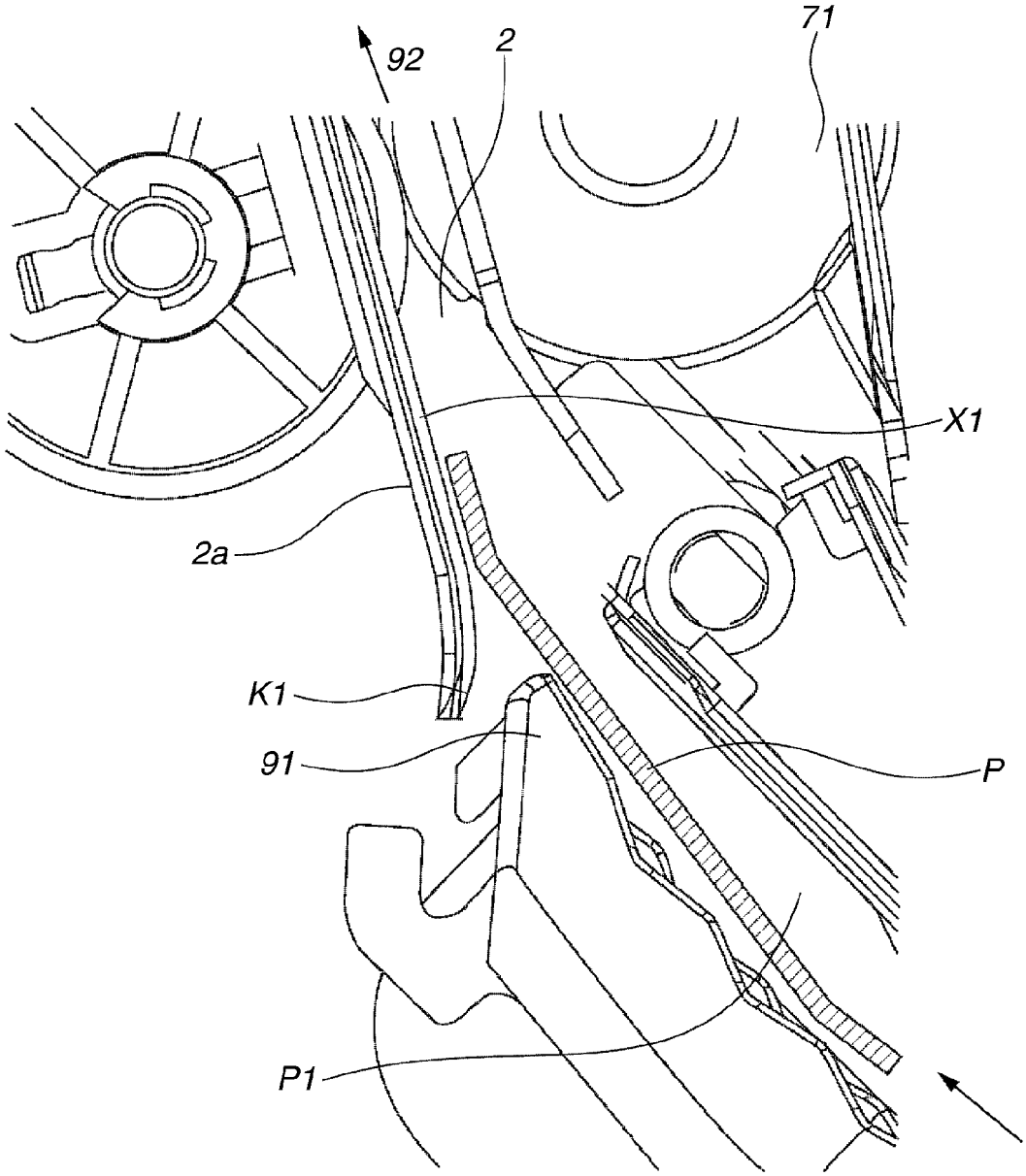
FIG. 4 illustrates a portion of an upstream side of a second inverse conveyance path in the sheet conveying apparatus of the exemplary embodiment of the present invention.

FIG. 4 is an enlarged diagram of an upstream portion of the second inverse conveyance path 2. An inverse lower guide member 91 serves as an upper guide, which forms an inverse conveyance path P1. The inverse lower guide member 91 and the outer guide 2*a* are configured of different members. The sheet P is guided, by the inverse roller 103 illustrated in FIG. 2, to the second inverse conveyance path 2 via the inverse lower guide member 91 of the inverse conveyance path P1 and conveyed in an arrow direction 92.

A downstream portion of the inverse lower guide member 91 is shifted from an upstream portion of the outer guide 2*a* in a thickness direction of the conveyed sheet. More specifically, as illustrated in FIG. 2, the downstream portion of the inverse lower guide member 91 is disposed to be above the start point K1 of the convey rib X1 of the outer guide 2*a*. This configuration enables conveying of the sheet without any contact with the rib start point K1.

As for the convey ribs X1 to Xn in the outer guide 2*a*, when the outer guide 2*a* is a plastic member, many convey guides X1 to Xn can be integrally formed on the surface of the outer guide 2*a*.

According to the present exemplary embodiment, as an example, the outer guide 2*a* is configured of integral members. However, the outer guide 2*a* may be configured of a base member, and separate convey ribs fixed to the base member.

Further, the outer guide 2*a* may be made of sheet metal instead of resin. When the outer guide 2*a* is made of sheet metal, convey ribs are formed by, for example, drawing press.

Further, according to the present exemplary embodiment, as an example, in the straight portion, at least some of the convey ribs are parallel to the sheet conveying direction. However, it is only required that the number of start points of the convey ribs is reduced by setting the convey ribs of the straight portion roughly parallel to the sheet conveying direction. In other words, to reduce the number of start points of the convey ribs, the convey ribs of the straight portion may be slightly tilted in the sheet conveying direction at an angle smaller than that of the curved portion in the sheet conveying direction.

In the present exemplary embodiment, for the sake of convenience of description, the straight portion is formed flat, which has no curve in the thickness direction of the conveyed sheet. However, the flat portion may have some curve (a degree of the curve is smaller than the curved portion) where strong rubbing of the convey ribs is not likely to occur.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-139670 filed May 28, 2008, which is hereby incorporated by reference herein in its entirety.

What is claimed is:

1. A sheet conveying apparatus comprising:

a guide unit configured to form a conveyance path on which a sheet to be conveyed passes, and including a curved portion and a flat portion; and a rib provided on the guide unit and configured to contact the sheet, the rib being disposed continuously extending over the curved portion and the flat portion in the guide unit, wherein the rib in the curved portion is angled with respect to a sheet conveying-direction toward a sheet width direction such that an angle toward the sheet width direction between the rib in the flat portion and the sheet conveying-direction is smaller than an angle toward the sheet width direction between the rib in the curved portion and the sheet conveying-direction.

2. The sheet conveying apparatus according to claim 1, further comprising additional ribs arranged in a direction intersecting the sheet conveying-direction, wherein two adjacent ribs of the rib and the additional ribs are spaced apart such that the two adjacent ribs avoid overlapping a line parallel to the sheet conveying direction.

3. The sheet conveying apparatus according to claim 1, further comprising an upper guide disposed on an upstream side of the guide unit in the sheet conveying direction, wherein a start point of the rib and a downstream side of the upper guide are shifted from each other in the thickness-direction of the sheet to set the start point of the rib to be outside a paper passing area.

4. The sheet conveying apparatus according to claim 1, wherein:

the guide unit includes a plurality of curved portions in the conveying direction, and the flat portion is disposed between the plurality of curved portions; and the rib continuously extends over the plurality of curved portions and the flat portion.

5. An image forming apparatus comprising:

the sheet conveying apparatus of claim 1;

an image forming unit configured to form an image on the sheet to be conveyed by the sheet conveying apparatus; and a fixing unit configured to fix the image formed by the image forming unit by heat, wherein the guide unit guides the sheet on which the image has been fixed by the fixing unit.

6. The sheet conveying apparatus according to claim 1, wherein the rib in the curved portion is angled away from a sheet conveying center such that the rib distance from the sheet conveying center increases when moving toward the downstream side of the guide unit in the sheet conveying-direction.

7. A sheet conveying apparatus comprising:

a guide unit configured to form a conveyance path on which a sheet to be conveyed passes, and including a curved portion and a flat portion; and a rib provided on the guide unit and configured to contact the sheet, the rib being disposed continuously extending over the curved portion and the flat portion in the guide unit, wherein the rib in the curved portion is angled with respect to a sheet conveying-direction toward a sheet width direction and the rib in the flat portion is not angled with respect to the sheet conveying-direction toward the sheet width direction.

8. The sheet conveying apparatus according to claim 7, further comprising an additional ribs arranged in a direction intersecting the sheet conveying-direction, wherein two adjacent ribs of the rib and the additional ribs are spaced apart such that the two adjacent ribs avoid overlapping a line parallel to the sheet conveying direction.

9. The sheet conveying apparatus according to claim 7, further comprising an upper guide disposed on an upstream side of the guide unit in the sheet conveying direction, wherein a start point of the rib and a downstream side of the upper guide are shifted from each other in the thickness-direction of the sheet to set the start point of the rib to be outside a paper passing area.

10. The sheet conveying apparatus according to claim 7, wherein:

the guide unit includes a plurality of curved portions in the conveying direction, and the flat portion is disposed between the plurality of curved portions; and the rib continuously extends over the plurality of curved portions and the flat portion.

11. An image forming apparatus comprising:

the sheet conveying apparatus of claim 7;

an image forming unit configured to form an image on the sheet to be conveyed by the sheet conveying apparatus; and a fixing unit configured to fix the image formed by the image forming unit by heat, wherein the guide unit guides the sheet on which the image has been fixed by the fixing unit.

12. The sheet conveying apparatus according to claim 7, wherein the rib in the curved portion is angled away from a sheet conveying center such that the rib distance from the sheet conveying center increases when moving toward the downstream side of the guide unit in the sheet conveying-direction.

* * * * *